US006146544A

United States Patent [19]

Guglielmi et al.

[11] Patent Number: 6,146,544

[45] **Date of Patent: *Nov. 14, 2000**

[54] ENVIRONMENTALLY BENIGN NON-TOXIC FIRE FLOODING AGENTS

[75] Inventors: Elio F. Guglielmi, Vancouver; Lorne D. MacGregor, Summerland, both of Canada

[73] Assignee: Lacovia N.V., Geneva, Switzerland

[ * ] Notice: This patent is subject to a terminal disclaimer.

[21] Appl. No.: 09/037,243

[22] Filed: Mar. 9, 1998

Related U.S. Application Data

[63] Continuation-in-part of application No. 08/636,165, Apr. 22, 1996, abandoned, which is a continuation-in-part of application No. 08/302,709, Nov. 18, 1994, Pat. No. 5,534,164.

[51] Int. Cl.[7] ..... A62D 1/08; A62D 1/02

[52] U.S. Cl. ..... 252/2; 252/8; 169/46

[58] Field of Search ..... 252/2, 8, 69; 169/46

[56] References Cited

U.S. PATENT DOCUMENTS

| | | | |
|---|---|---|---|
| 3,356,610 | 12/1967 | Maestre et al. | 252/8 |
| 4,954,271 | 9/1990 | Green | 252/8 |
| 5,120,461 | 6/1992 | Logsdon et al. | 510/411 |
| 5,306,850 | 4/1994 | Darago | 203/6 |
| 5,558,810 | 9/1996 | Minor et al. | 252/67 |
| 5,759,430 | 6/1998 | Tapscoh et al. | 252/8 |
| 5,856,587 | 1/1999 | Visca et al. | 568/677 |

*Primary Examiner*—Jill Warden
*Assistant Examiner*—LaToya Cross
*Attorney, Agent, or Firm*—Oyen Wiggs Green & Mutala

[57] ABSTRACT

Fire flooding and extinguishing agents and detoxifiers which are environmentally safe and non-toxic in both natural form and in fire exposed degraded forms are disclosed. The flooding and streaming-type fire extinguishing agents are rich in low boiling, unsaturated halocarbon compounds having low liquid viscosities, and low boiling alkenes as detoxifying agents. The detoxifiers are conjugated double bond hydrocarbons.

2 Claims, No Drawings

ENVIRONMENTALLY BENIGN NON-TOXIC FIRE FLOODING AGENTS

This application is a continuation-in-part of application Ser. No. 08/636,165, filed Apr. 22, 1996 now abandoned, which was a continuation-in-part of application Ser. No. 08/302,709, filed Nov. 18, 1994, now U.S. Pat. No. 5,534,164, granted Jul. 9, 1996.

FIELD OF THE INVENTION

This invention involves novel total flooding and streaming-type fire extinguishants and novel detoxifiers which are environmentally safe and non-toxic in natural form as well as in fire exposed degraded forms.

DESCRIPTION OF THE PRIOR ART

In recent years, it has been discovered that certain halocarbons such as CFC 11, CFC 12, HALON 1301, and the like, which have been widely used as refrigerants, blowing agents and fire extinguishants are damaging to the environment because they accumulate in the stratosphere and damage the integrity of the ozone layer, which protects life on earth from harmful radiation from the sun and space. These harmful substances are being phased out of production.

Halocarbons have been used as fire extinguishants. U.K. 1,603,867, Thacker, discloses CFC 11 and CFC 12 in combination with a monoterpene, that is, an essential oil or citrous oil, as a fire extinguishing agent. A monoterpene is defined in the chemical literature as $C_{10}H_{16}$. As stated, CFC 11 and CFC 12 are now well known to be detrimental to the ozone layer.

Halocarbon extinguishants fall into two broad groups, streaming agents and flooding agents. A streaming agent is directed at the source of the fire and should be high boiling to thereby resist decomposition until it reaches the source of the fire. A flooding agent fills a volume around the fire and smothers the fire. It should be low-boiling so that it vaporizes readily.

U.S. Pat. No. 4,826,610, issued May 2, 1989, Derek A. Thacker, discloses a firefighting composition comprising one or more halocarbons, namely HALONS 11 (CFC 11), 12 (CFC 12), 113 (CFC 113) and 114 (CFC 114), together with 1% to 14% by weight of the extinguishant base of a sesquiterpene and one or more essential oils. A sesquiterpene is a compound having the formula $C_{15}H_{24}$. Solvents and dispersing agents may also be provided. This composition is suited for stream-type firefighting situations. The formulation is not touted to be ozone friendly.

U.S. Pat. No. 4,954,271, issued Sep. 4, 1990, Raymond W. Green, discloses and protects high boiling environmentally amicable stream-type fire extinguishing agents. The stream-type agents comprise in combination: (a) more than 50% by weight of a fluorochlorocarbon selected from the group consisting of: 1,1-dichloro-2,2,2-trifluoroethane, and 1,2-dichloro-2,2-difluoroethane; (b) less than 48% by weight of a fluorocarbon selected from the group consisting of: chlorodifluoromethane, 1-chloro-1,2,2,2-tetrafluoroethane, pentafluoroethane, 1,2,2,2-tetrafluoroethane; and (c) a detoxifying substance selected from the group consisting of terpenes: citral, citronellal, citronellol, limonene, dipentene, menthol, terpinene, terpinolene, sylvestrene, sabinene, methadiene, zingiberene, ocimene, myrcene, α-pinene, β-pinene, turpentine, camphor, phytol, vitamin A, abietic acid, squalene, lanosterol, saponin, oleanolic acid, lycopene, β-carotene, lutein, α-terpineol, and p-cymeme; and unsaturated oils; oleic acid, linoleic acid, linolenic acid, eleosearic acid, lincanic acid, ricinoleic acid, palmitoleic acid, petroselenic acid, vaccenic acid, and erucic acid, in the range of from 2 to 10% by weight.

In the chlorofluorocarbon stream-type mixtures taught by Green, it is emphasized that high boiling chlorofluorocarbons should comprise more than 50% weight of his mixtures. In contrast, low boiling compounds must be less than 50% weight (see column 2, lines 22–27). In the examples disclosed in Green, a low boiling chlorofluorocarbon such as CFC 12, which boils at −30° C., amounts to 15% weight of the total formulation. The other components are in the vast majority and boil at temperatures well above 0° C. For instance, in Example 2 of Green, column 4, line 61, the boiling point of the NAF Interior Mixture is stated as being 10° C. Thus, the high boiling mixtures disclosed by Green are useful as stream-type extinguishants and are virtually the opposite of the low boiling mixtures which are suitable as flooding agents.

Two U.S. patents, U.S. Pat. No. 5,141,654, issued Aug. 25, 1992, Fernandez, and U.S. Pat. No. 5,393,438, issued Feb. 28, 1995, Fernandez, are of general interest because they disclose extinguishants. Both patents of Fernandez disclose chlorofluorocarbons which are not fully halogenated, with the provision that there be at least one fluorine atom (see column 2, line 57, of U.S. Pat. No. 5,141,654) in each halocarbon. However, the halocarbons are used in pure form. There is no disclosure in either Fernandez patent of using one or more detoxifying substances. Furthermore, neither Fernandez patent discloses any significance inherent with low boiling chlorofluorocarbons.

SUMMARY OF THE INVENTION

The invention pertains to a fire extinguishing mixture of the formula:

(a) about 90% to 100.0% wt. of a halocarbon selected from the group consisting of:
- hydrochlorofluorocarbon.21—dichlorofluoromethane
- hydrochlorofluorocarbon.22—chlorodifluoromethane
- hydrofluorocarbon 23—trifluoromethane
- hydrochlorofluorocarbon.123—2,2-dichloro-1,1,1-trifluoroethane
- hydrochlorofluorocarbon.123a—1,2-dichloro-1,1,2-trifluoroethane
- hydrochlorofluorocarbon.124—2-chloro-1,1,1,2-tetrafluoroethane
- hydrochlorofluorocarbon.124a—1-chloro-1,1,2,2-tetrafluoroethane
- hydrofluorocarbon 125—pentafluoroethane
- hydrochlorofluorocarbon.131—chlorotrifluoroethane
- hydrochlorofluorocarbon.132—1,2-dichloro-1,1-difluoroethane
- hydrochlorofluorocarbon.133—2-chloro-1,1,1-trifluorethane
- hydrofluorocarbon.134a—1,1,1,2-tetrafluoroethane
- hydrofluorocarbon.227—heptafluoropropane
- hydrofluorocarbon.236—hexafluoropropane
- hydrofluorocarbon.245—pentafluoropropane; and (b) between 0.25 and 10% by weight of a detoxifying substance selected from the group consisting of all isomers of:

| | | |
|---|---|---|
| ethene | propene | butene |
| isoprene | pentene | isopentene |
| trimethyl ethene | tetramethyl ethene | butadiene |
| pentadiene | isobutylene | dimethyl butadiene |
| hexene | hexadiene | methyl pentadiene |
| hexatriene | | |

the mixture having a boiling point of between about −85° to about 25° C., preferably a range of between about −80° C. to about −10° C., a formula molecular weight in the range of about 70 to 250, and a vapour pressure of about 0.1 MPa to about 5 MPa at 25° C., said fire extinguishing agent being non-toxic and environmentally benign in both natural form and degraded fire exposed form.

In another aspect, the invention pertains to an additive for halogenated fire extinguishants and fire extinguishing flooding mixtures consisting of one or more hydrocarbons having from two to six carbon atoms, with one or more double bonds, said additive reducing the amount of hydrogen halides and carbonyl halides that are produced on exposure of the extinguishant or mixtures to fire. The additive for halogenated fire extinguishants and fire extinguishing mixtures can have four or more carbon atoms with two or more double bonds, where at least two of the double bonds are conjugated.

The additive can be selected from the group consisting of all isomers of:

| | | |
|---|---|---|
| ethene | propene | butene |
| isoprene | pentene | isopentene |
| trimethyl ethene | tetramethyl ethene | butadiene |
| pentadiene | isobutylene | dimethyl butadiene |
| hexene | hexadiene | methyl pentadiene |
| hexatriene | | |

The invention is also directed to specific additives for halogenated fire extinguishants and fire extinguishing mixtures both for streaming and total flood use consisting of 1,3-butadiene and of isoprene, said additive reducing the amount of hydrogen halides and carbonyl halides that are produced by the halogenated fire extinguishants and fire extinguishing mixtures on exposure to fire. The fluid viscosity of the mixture can be below 1.0 centipoise between the initial boiling point of the mixture and 25° C.

The invention is also directed to a non-toxic environmentally benign fire extinguishing mixture for use in a flooding fire extinguishing technique, said fire extinguishing mixture comprising about 82% by weight HCFC-22, about 9.5% by weight HCFC-124, about 4.75% by weight HCFC-123 and about 2% by weight 1,3-butadiene.

DETAILED DESCRIPTION OF PREFERRED EMBODIMENTS OF THE INVENTION

The inventors have determined that fully halogenated halocarbons are highly stable, have long lifetimes, and are difficult to decompose. Thus when fully halogenated halocarbons enter the stratosphere, they take a long time to decompose and hence the damage time on the ozone layer is extensive.

Specifically, two chlorofluorocarbons disclosed in Thacker, U.S. Pat. No. 4,826,610, are fully halogenated compounds. In other words, all of the available substitution positions on the carbon backbone are taken up by either chlorine or fluorine. Thacker did not recognize that fully halogenated chlorofluorocarbon compounds are highly stable, difficult to decompose, and hence are a primary enemy of the ozone layer enveloping the earth.

Specifically, Green discloses high boiling fully and partially halogenated chlorofluorocarbon mixtures which are suitable as streaming extinguishants. The Green mixtures comprise the following chlorofluorocarbons: CFC 11, CFC 12, CFC 22, CFC 114, HCFC 123, HCFC 124, HFC 125, HCFC 132 and HFC 134. Of these chlorofluorocarbons, CFC 11, CFC 12 and CFC 114 are fully halogenated chlorofluorocarbons. Green did not acknowledge the difference between fully and partially halogenated chlorofluorocarbons and that chlorofluorocarbons that are fully saturated with halogen atoms are difficult to decompose and are harmful to the ozone layer protecting the earth.

The inventors have invented a family of low boiling partially halogenated chlorofluorocarbon formulations, which are ideal as fire flooding agents. Furthermore, the formulations are environmentally benign because the halocarbons are not fully halogenated, that is, there is always at least one hydrogen atom present in the chlorofluorocarbons and fluorocarbons comprising the family. In other words, the low boiling partially halogenated chlorofluorocarbon compounds disclosed herein provide at least one hydrogen site on each molecule which thereby provides a location for the breakdown or decomposition of the molecule.

The exact chemical nature of a fire is highly variable and not well characterised. It will vary with the physical environment of the fire as well as the fuel or fuels feeding the fire. The physical environment can affect the availability of oxygen to the fire and thus affect the stoichiometry of the flames and the flame temperatures. Further variability is introduced by the introduction of a fire extinguishant. Nevertheless, all fires retain some common characteristics: (1) they are very hot (on the order of 1000° C.); (2) they are an oxidizing environment; and (3) there are a large number of highly reactive species present. When a halogenated hydrocarbon fire extinguishant comes in contact with fire, the fire is not extinguished immediately. There is a period of time which varies with the extinguishant, the precise method of application of the extinguishant, and the exact nature of the fire when the fire extinguishant is reacting with the fire. During this period, the fire extinguishant is decomposed and produces halogen radicals. The radicals are highly reactive and go on to form undesirable toxic products such as hydrogen halides (HF, HCl, HBr, HI) and carbonyl halides ($COF_2$, etc.).

The inclusion of hydrogen in a compound changes the physical and chemical characteristics of that compound sufficiently that it is not immediately predictable or obvious that the compound including the hydrogen atom will function or perform in a manner that is similar to compounds which are fully halogenated. The inclusion of hydrogen, a highly flammable and reactive element in its uncombined form, in a fully halogenated hydrocarbon to thereby render it only partially halogenated, can be expected by a person skilled in the art to dramatically alter the chemical characteristics of the fully halogenated hydrocarbon. It is unlikely that a person skilled in the art would expect that a partially halogenated aliphatic hydrocarbon could be substituted for a fully halogenated aliphatic hydrocarbon in a flood-type fire extinguishing mixture because the results would not be predictable.

Furthermore, knowledge acquired by a skilled artisan from stream-type halocarbon extinguishants cannot be extrapolated with predictability to flood-type halocarbon extinguishants.

At the time of development of the Thacker and Green stream-type fire extinguishing formulations, indiscriminately using by and large high boiling fully halogenated chlorofluorocarbons, Thacker and Green did not disclose that such chlorofluorocarbons would be damaging to the ozone layer encompassing the earth. Furthermore, Thacker and Green would not have been aware of global warming consequences of their fully halogenated chlorofluorocarbons.

The low boiling fire flooding mixtures disclosed by the inventors herein are partially halogenated halocarbons and have highly desirable low ozone depletion potentials, and perform well as fire flooding agents, in natural form as well as degraded form which occurs on exposure of the extinguishant to fire.

We have also invented a family of low boiling hydrocarbons of two to six carbons with one or more double bonds in each molecule, for use in detoxifiers (or acid scavengers) in association with low-boiling halocarbons used as flooding-type extinguishants.

Dienes are alkenes which contain not one but two double bonds. There are three types of dienes: ones with isolated double bonds, where the double bonds are separated by at least two single bonds; cumulated double bonds where the double bonds are adjacent to each other; and conjugated double bonds where the double bonds are separated by one single bond. Dienes with isolated double bonds react similarly to simple alkenes as the isolated double bonds have little effect on each other. Conjugated dienes react quite differently from simple alkenes. Simple alkenes tend to undergo 1,3-addition while conjugated dienes undergo 1,4-addition. Conjugated dienes are also much more reactive to radical addition. Further details on this can be found in most organic chemistry textbooks such as Morrison and Boyd, "Organic Chemistry", 3rd ed., Allyn and Bacon Inc., Boston, Mass.

Overall, we have invented a family of lower alkenes detoxifying agents which, when used in combination with a family of new hydrochlorofluorocarbon and hydrofluorocarbon fire extinguishing agents, make ideal flood-type fire extinguishants and also render the decomposed halocarbons non-toxic and cause minimum damage to the ozone layer of the earth. The family of flood-type extinguishants we have invented contain no bromofluorocarbons which have been discovered to have serious ozone damaging effects.

The environment where these scavenging reactions are taking place is quite different from those that would normally be encountered in an industrial situation. Industrial reactions, particularly those involving halocarbons, are often carried out at elevated pressure with the temperature usually controlled to no more than about 200° C. The chemicals present are also usually carefully controlled with only minor amounts of impurities present. This is in contrast to the scavenging reaction envisioned by the present invention where the reactions take place at atmospheric pressure, and the reaction temperature is uncontrolled but varies up to the flame temperature for the fuels involved. There can be a wide variety of potential reactants present and these will be variable from time to time and spatially across the flame.

Fire extinguishing mixtures for flooding applications, that is, smothering the fire by filling a volume space, as opposed to streaming the fire extinguishing agent onto the source of the fire, should be considerably more volatile than for streaming-type applications. In streaming applications, the mixture should remain cohesive and resist decomposition due to heat, until it reaches the source of the fire. The need for cohesion of the mixture in flooding-type situations is not only reduced but in fact cohesion becomes detrimental to rapid dispersion of the agent throughout the volume. Thus, for flooding applications, it is desirable that the halocarbons making up the extinguishant have low boiling points. It is also desirable that the detoxifying substance used in the formulations for flooding applications have a lower boiling point than that used for streaming-type applications. Lower boiling points of both the halocarbons and the detoxifiers promote dispersion.

Apart from that, we have discovered that some of the substances listed by Thacker and Green can in some cases leave an undesirable terpene or sesquiterpene residue when used in flooding applications to extinguish fires (even though the Green and Thacker formulations are primarily intended for stream-type use).

While we do not wish to be bound by any theories, we believe that the halogen scavenging by the detoxifier when a halocarbon is used as a fire extinguishant takes place on a molecular basis and thus lower molecular weight detoxifiers are required at a lower weight fractions of halocarbons to achieve the same degree of detoxification as in the case of higher molecular weight compounds.

We have discovered that low-boiling light hydrocarbons with two or more conjugated double bonds are particularly effective as detoxifiers (acid scavengers) for low-boiling halocarbons used as flooding extinguishants. There is resonance stabilization of formed intermediate products during the halogen scavenging process when the low-boiling halocarbons are used as a flooding fire extinguishants. Alkenes, having six or less carbons and one or more double bonds, have higher vapour pressures and lower boiling points than the terpene additives listed by Green.

Again, regarding halocarbons and ozone layer damage, we do not wish to be bound by any adverse theories. However, we offer the following discussion as a possible aid to understanding why the low boiling halocarbons we have invented are successful as environmentally friendly flood-type extinguishants. Halocarbons which contain at least one hydrogen, we believe, are generally more environmentally benign than their fully halogenated counterparts because the presence of even a single hydrogen on a halocarbon molecule provides a site which is subject to attack by hydroxyl radicals. This leads to breaking down of the molecule and a drastic reduction in the atmospheric lifetime of the molecule. The ozone depletion potential of a compound is, we believe, dependent on its atmospheric lifetime mainly due to the long time that it takes the compound to be transported from near the earth's surface up and into the stratosphere. Global warming potentials are also strongly dependent on atmospheric lifetime as the time integrated climate forcing of even a strongly absorbing molecule will be minimal if the molecule does not survive a significant time in the atmosphere. Our invention therefore involves using partially halogenated halocarbons which contain at least one hydrogen to thereby provide a molecule breakdown site and thus the compound is relatively environmentally benign.

When a flooding or inerting fire extinguishing technique is to be used, that is, where the extinguishant is released into an enclosed volume containing a fire, and maximum toxic decomposition products are generated, we have discovered that fires of this type are quickly and safely extinguished using low-boiling partially halogenated nontoxic mixtures as follows:

(a) 90 to 99.9% by weight of one or more of:
dichlorofluoromethane (HCFC 21)
chlorodifluoromethane (HCFC 22)
trifluoromethane (HFC 23)
dichlorotrifluoroethane (HCFC 123)
chlorotetrafluoroethane (HCFC 124)
pentafluoroethane (HCFC 125)
dichlorodifluoroethane (HCFC 132)
chlorotrifluoroethane (HCFC 133)
tetrafluoroethane (HCFC 134)
heptafluoropropane (HFC 227)
pentafluoropropane (HFC 245)
hexafluoropropane (HCFC 236)

(b) 0.1% to 10% weight of one or more hydrocarbons having from two to six carbon atoms, and one or more double bonds.

The mixture should be relatively volatile and preferably have a boiling point between −85° C. and 25° C., a formula molecular weight between 70 and 250 and a vapour pressure between about 0.1 MPa and 5 MPa at 25° C.

The 0.1% to 10% by weight of any one or more detoxifying hydrocarbons with from two to six carbon atoms, with one or more double bonds, may be one or more isomers of one or more of the following light alkenes:

| | | |
|---|---|---|
| ethene | propene | butene |
| isoprene | pentene | isopentene |
| trimethyl ethene | tetramethyl ethene | butadiene |
| pentadiene | isobutylene | dimethyl butadiene |
| hexene | hexadiene | methyl pentadiene |
| hexatriene | | |

The precise choice of agents and compositions will be governed in each case by a balance of cost, factors governing fluid and vapor flow, factors governing fluid and vapor physical characteristics, and the configuration of the extinguishant flooding system needed to protect the intended volume(s).

We have also discovered that for extinguishing fires in enclosed volumes by flooding or inerting techniques, it is critical that the initial boiling point of the fire extinguishant is low. This includes both the halocarbons and the detoxifier. We have also discovered that it is important in such flooding fire extinguishants that the detoxifying agent(s) has a low boiling point which coincides closely with that of the halocarbon(s) so that they volatilize at the same time.

The mixtures we have invented that are suitable for flooding or inerting fire extinguishing agents have the following beneficial characteristics and attributes:

1. The class of fire flooding mixtures according to the invention must be rich in lower boiling compounds, and not exhibit much cohesion. The flooding class we have described will therefore rapidly vaporize and flood the intended volume with extinguishant to a concentration level that is required to extinguish the included fire.

2. The low boiling points exhibited by our class of flooding mixtures enables low boiling detoxifying agents to be used. This comprises low boiling light alkenes which cannot, because of their low boiling points, be successfully used with higher boiling streaming-type extinguishants.

3. We have found surprisingly that when the detoxifying agents are eliminated completely from the fire extinguishing mixtures, the fire extinguishing capacity is less efficient than when the detoxifying compounds are included in the agents. Also, when detoxifying lower alkenes are omitted, dangerous levels of toxic halogen and hydrogen halides are produced when the halocarbon extinguishant mixture is decomposed by the heat of the fire.

4. To maximize the foregoing attributes, we have determined that the physical characteristics of a flooding mixture should have a boiling range between −80° C. and −10° C. It should also have a liquid viscosity less than 1.0 centipoise throughout a temperature range from initial boiling point of the mixture to approximately 25° C.

EXAMPLE 1

In one particular test, a test chamber measuring 0.5×3×3 meters and containing five standard pot fires was flooded using a pipe system about 3 meters in total length. The pot fires were extinguished in less than 10 seconds by using 1 kg of a mixture consisting of 96 percent by weight of chlorodifluoromethane and 4 percent by weight of limonene through the pipe. This mixture had an initial boiling point of −40.5° C. and a liquid viscosity of 0.21 centipoise at 25° C.

EXAMPLE 2

In another evaluation using the same test chamber as in Example 1, the five pot fires were extinguished in less than 10 seconds using 1 kg of a mixture consisting of 85 percent by weight of chlorodifluoromethane, 11.5 percent by weight of 1-chloro-1,2,2,2-tetrafluoroethane, and 3.5 percent by weight of dipentene.

EXAMPLE 3

In a further evaluation using the same test chamber as in Example 1, the five pot fires were extinguished in less than 10 seconds using 1 kg of a mixture consisting of about 75 percent by weight of chlorodifluoromethane, about 11.75 percent by weight of 1,1-dichloro-2,2,2-trifluoroethane, about 9.5 percent by weight of 1-chloro-1,2,2,2-tetrafluoroethane, and about 3.75 percent by weight of limonene.

EXAMPLE 4

In fire extinguishing tests conducted using a mixture of HCFC's in the ratio 82:9.5:4.75 HCFC-22:HCFC-124:HCFC-123, it was found that when 2 parts of 1,3-butadiene were added, the HF concentrations generated decreased by 60% compared to the tests where no hydrocarbon was added to the HCFC mixture.

These examples vividly demonstrate the key role that low fluid viscosity and low boiling point plays in parameterizing the mixtures required to achieve optimum volume of flood-type fire extinguishing performance. The goal is to achieve mixtures having an initial boiling point approximating −60° C. and a fluid viscosity approximating 0.15 centipoise at 25° C.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A halogenated fire extinguishing flooding mixture comprising:

(a) about 90% to 99.9% wt. of one or more species of partially halogenated hydrocarbon fire extinguishant, said partially halogenated hydrocarbon fire extinguishant containing at least one hydrogen atom; and (b) about 0.1% to 10% wt. of a detoxifying agent comprised of 1,3-butadiene, said detoxifying agent reducing the amount of hydrogen halides and carbonyl halides that are produced on decomposition of the mixture due to exposure of the mixture to fire, said flooding mixture having a boiling point of between about −85° C. to 25° C.

2. A non-toxic environmentally benign fire extinguishing mixture for use in a flooding fire extinguishing technique, said fire extinguishing mixture comprising about 82% wt. HCFC-22, about 9.5% wt. HCFC-124, about 4.75% wt HCFC-123 and about 2% wt. 1,3-butadiene.

* * * * *